US012139306B2

(12) United States Patent
Smith

(10) Patent No.: US 12,139,306 B2
(45) Date of Patent: Nov. 12, 2024

(54) HINGED CLOSURE

(71) Applicant: Creanova Universal Closures Limited, Tewkesbury (GB)

(72) Inventor: Mark Smith, Cheltenham (GB)

(73) Assignee: Creanova Universal Closures Limited, Tewkesbury (GB)

( * ) Notice: Subject to any disclaimer, the term of this patent is extended or adjusted under 35 U.S.C. 154(b) by 286 days.

(21) Appl. No.: 17/596,324

(22) PCT Filed: Jun. 5, 2020

(86) PCT No.: PCT/EP2020/065611
§ 371 (c)(1),
(2) Date: Dec. 7, 2021

(87) PCT Pub. No.: WO2020/245346
PCT Pub. Date: Dec. 10, 2020

(65) Prior Publication Data

US 2022/0227547 A1 Jul. 21, 2022

(30) Foreign Application Priority Data

Jun. 7, 2019 (CH) ..... 778/19
Oct. 28, 2019 (CH) ..... 1362/19

(51) Int. Cl.
*B65D 47/08* (2006.01)
*B65D 1/02* (2006.01)
*B65D 41/04* (2006.01)

(52) U.S. Cl.
CPC ..... *B65D 47/0804* (2013.01); *B65D 1/0246* (2013.01); *B65D 41/0414* (2013.01)

(58) Field of Classification Search
CPC .. B65D 85/1045; B65D 41/04; B65D 41/086; B65D 39/08; B65D 39/10; B65D 47/0804; B65D 1/0246; B65D 41/0414
See application file for complete search history.

(56) References Cited

U.S. PATENT DOCUMENTS 4,793,502 A * 12/1988 Beck ..... B65D 47/0814 220/838
5,007,555 A * 4/1991 Beck ..... B65D 47/0809 220/838

(Continued)

FOREIGN PATENT DOCUMENTS

EP 0844190 A1 5/1998
EP 2641841 A1 9/2013
WO 2019/043274 A1 3/2019

OTHER PUBLICATIONS

International Search Report and Written Opinion in PCT/EP2020/065611 mailed Sep. 15, 2020.

*Primary Examiner* — Kareen K Thomas
(74) *Attorney, Agent, or Firm* — MASCHOFF BRENNAN; Paul G. Johnson

(57) ABSTRACT

Closure (1), for sealing of a neck finish (2) of a liquid container, comprising a top deck (3) and an outer skirt (4) extending from the top deck (3) in an axial direction (z) away from the top deck (3). The outer skirt (4) comprises a top section (5) arranged adjacent to the top deck (2) and a bottom section (6) separated from the top section (5) by a gap (7). The top section (5) and the bottom section (6) are interconnected to each other by a hinge (8). The outer skirt (4) comprises an inwardly protruding locking bead (9) extending along an inner surface (10) of the outer skirt (4), wherein the locking bead (9) at at least one location continues across the gap (7).

14 Claims, 3 Drawing Sheets

(56) References Cited

U.S. PATENT DOCUMENTS

| | | | | |
|---|---|---|---|---|
| 5,143,234 | A * | 9/1992 | Lohrman | B65D 47/0809 215/354 |
| 5,335,802 | A * | 8/1994 | Brach | B29C 45/26 215/253 |
| 5,558,239 | A * | 9/1996 | Dubach | E05D 1/02 220/838 |
| 6,170,683 | B1 * | 1/2001 | Montgomery | B65D 41/3442 220/291 |
| 6,634,060 | B1 * | 10/2003 | Lagler | B65D 50/046 220/837 |
| 6,766,926 | B1 * | 7/2004 | Elchert | B65D 51/20 222/546 |
| 9,415,909 | B2 * | 8/2016 | Druitt | B65D 47/0809 |
| 10,358,269 | B2 * | 7/2019 | Cerveny | B65D 47/0842 |
| 2009/0026166 | A1 | 1/2009 | Druitt | |
| 2010/0005641 | A1 * | 1/2010 | Druitt | B65D 50/061 215/237 |

* cited by examiner

HINGED CLOSURE

FIELD OF THE INVENTION

The present invention relates to a closure, especially a closure for containers for liquids. In particular, the invention relates to a hinged closure for the application on blow moulded container neck finishes.

BACKGROUND OF THE INVENTION

Containers for large volumes of liquids such as e.g. containers for washing agents or milk bottles are often blow molded plastic containers. These containers generally feature thin walls and have geometric inaccuracies and seams at a neck finish and the opening of the container. The closures for these large volume containers must be easy to handle due to a relatively high weight of a filled container, which a user often has to hold during opening of the container. Hence, these closures may preferably be opened and reclosed one handed. Furthermore, additional requirements arise due to the high manufacturing tolerances of blow molded containers, making it difficult to reliable close and seal the containers. However, at the same time, the manufacturing costs of these closures, respectively the overall container, usually have to be kept low.

It is an object of the invention to provide a closure for a neck finish of a liquid container which is easily opened and reclosed. It is a further object of the invention to provide a closure that is cost effective to manufacture.

SUMMARY OF THE INVENTION

The invention relates to a closure for sealing of a neck finish of a liquid container. The closure comprises a top deck and an outer skirt extending from the top deck in an axial direction away from the top deck. The outer skirt comprises a top section arranged adjacent to the top deck and a bottom section separated from the top section by a gap. The top section and the bottom section are interconnected to each other by at least one hinge, such as e.g. a snap hinge. In an initial position, before initial opening of the closure, the top section and the bottom section can be interconnected by at least one fragile bridge, which tears during initial opening. The torn bridges indicate the prior use, respectively the prior opening of the liquid container.

A locking bead protrudes from an inner surface of the outer skirt inwardly in the radial direction towards a center axis of the closure and extends along said inner surface. The locking bead hereby continues at least at one location across the gap between the bottom section and the top section. The locking bead may thus be divided by the gap in at least one (first) segment arranged on the bottom section and at least one (second) segment arranged on the top section. The segment of the locking bead arranged on the bottom section of the outer skirt serves to secure the closure on the neck finish of the container. Meanwhile, the segment of the locking bead arranged on the top section primarily serves to open and reclose the closure as described in more detail in the following.

Depending on the design and the application of the closure, the locking bead may be i.g. a thread to screw the closure on a corresponding external thread of the neck finish of the liquid container. If the locking bead is a thread, the first thread segment (arranged on the bottom section) and the second thread segment (arranged on the top section) preferably have a uniform thread angle over the gap. Alternatively, the locking bead may also serve to snap the closure on the neck finish such that an undercut is formed in the axial direction between the locking bead and at least one corresponding protrusion arranged on the neck finish. Depending on the closure design, the locking bead may be segmented.

For opening the liquid container, the top section and the top deck of the closure are removed, respectively folded or bend away from the bottom section around the hinge. If fragile bridges are present, these bridges tear during this process. In a closed position of the closure, the (second) segment of the locking bead arranged on the top section forms an undercut with a corresponding protrusion on the neck finish of the container in the axial direction. In case, the locking bead is a thread, the undercut is formed with the external thread of the neck finish. For moving the closure from the closed position (where the opening in the liquid container is covered) to an open position (where the opening in the liquid container is open), the top section and/or the second segment of the locking bead arranged on the top section deforms such that the second segment is released.

To facilitate this deformation and thus simplify the opening and the reclosing of the closure, the top section may comprise at least one fastening flap extending from a lower end of the top section in the axial direction with the locking bead continuing across the gap into the fastening flap. The gap can thus divide the locking bead in at least one first segment arranged on the bottom section of the outer skirt and at least one second segment arranged on the fasting flap. The locking bead may further cross the gap at a first location into the fastening flap, continuing along the outer skirt and crossing the gap at a second location from the fastening flap back to the bottom section.

The fastening flap may comprise the same wall thickness than the top and/or the bottom section adjacent to the fastening flap. The wall thickness being defined as the thickness of the outer skirt in the radial direction. Preferably, the fastening flap is arranged within a contour of the outer skirt and/or within a contour of the top deck in the axial direction. The fastening flap can have an essentially rectangular shape in the radial direction. However, other shapes are also possible. For a reliable locking, the fasting flap, respectively the thereon arranged (second) segment of the locking bead may be arranged over $\alpha$=10-35 deg (degree), in particular over $\alpha$=15-25deg of the circumference of the outer skirt with respect to the center axis. The fastening flap preferably extends in the axial direction inside a recess of the bottom section of the outer skirt. The recess may follow the outer contour of the fastening flap along the gap. Advantageously, the fastening flap protruding from the lower end of the top section is elastically deformable. Additionally, or alternatively, the fastening flap may be configured bendable in the radial direction around its base arranged on the lower end of the top section. This facilitates the opening and reattachment of the top section. At least one thinning may be arranged in the region of the base of the fasting flap to enhance the bendability, respectively the deformability of the flap.

For an easy handling, the top section may comprise a brim extending in a radial direction away from the top section to facilitate opening of the closure. Preferably, the brim is arranged only partially over the circumference of the closure, advantageously in the circumferential direction opposite of the hinge. The brim serves to help a user to grip and flip back the top section during opening of the closure. In a preferred variation of the invention, the closure comprises two fasting flaps with respective recesses. Preferably, the fasting flaps are thereby arranged in the circumferential direction on both sides adjacent to the brim.

Depending on the application, the closure may further comprise a sealing means on an inner surface of the top deck. The sealing means can comprise at least one deformable sealing lip extending in a circumferential manner along an inner surface of the top deck. The sealing lip(s) can be arranged with respect to its cross-section in an inclined manner facing radially inwards towards the center axis and away from the outer skirt. Preferably the sealing means comprises a primary and a secondary sealing lip arranged coaxially with respect to each other. The primary and/or the secondary sealing lip are advantageously deformable such that the secondary sealing lip supports the deformed primary sealing lip with respect to the neck finish in the applied position of the closure.

The closure can further comprise at least one first locking tooth arranged on the inner surface on the bottom section foreseen to engage in the circumferential direction behind a complementary second locking tooth on the neck of the liquid container in an applied position of the closure on the liquid container. On one hand, the (first and second) locking teeth prevent the closure to be removed from the neck finish once attached. On the other hand, the (first and second) locking teeth lock, respectively position, the closure in a predefined manner on the neck finish in the circumferential direction. The latter is especially advantageous, if the locking bead is a thread, since the axial position of the thread differs over the circumference of the closure. The at least one first locking tooth may comprise at least one locking shoulder which serves to form an undercut with a corresponding shoulder of the second locking tooth in the circumferential direction. Hence, the locking shoulder is arranged advantageously perpendicular with respect to the circumferential direction. Depending on the design of the closure, the at least one locking tooth may comprise at least one tapered surface, configured to guide the corresponding second locking tooth towards the locking shoulder and in the locked position. Preferably the tapered surface is inclined starting from the inner surface of the outer skirt in the radial direction inwards (with respect to and seen form the axial direction). The second locking tooth may be designed correspondingly. The at least one first locking tooth can be arranged in the area of a lower end of the bottom section (in the axial direction). The at least one first locking tooth may be arranged adjacent to the at least one recess of the bottom section. Preferably, two first locking teeth are arranged on both sides of the recess.

Depending on the application, the closure may comprise an inner skirt extending from an inner surface of the top deck in the axial direction away from the top deck. Preferably, the inner skirt extends from the inner surface of a top dish of the top deck, as explained further below. The inner skirt is thus circumvented by the outer skirt in the radial direction. The inner skirt is preferably arranged coaxially with respect to the outer skirt and/or with respect to the center axis of the closure. Preferably, the inner skirt comprises on a first surface, which is facing towards the outer skirt, a circumferential sealing bead. The inner skirt may vary in length in the axial direction over its circumference. The inner skirt can comprise an extended part that is extending further in the axial direction than the rest of the inner skirt. The extended part is preferably arranged at the same circumferential position than the hinge. A top seal may be present on the inner surface of the top deck between the inner skirt and the outer skirt for contacting and sealing the top end of the neck finish from the axial direction.

Depending on the application, it may be advantageous if the top deck has a staggered design. The top deck may comprise a top dish and a rim circumventing the top dish. The top dish may further have an offset with respect to the rim in the axial direction and towards the outer skirt. This design allows for less collision risk during opening and closing of the closure, especially if the closure comprises an inner skirt extending from the top dish since the hinge may be positioned at a more upwards position. Between the rim and the top dish a transition area may be present. The transition area may be e.g. a bevelled surface angled towards the center axis. On the transition area, respectively on the bevelled surface, additional rips and/or a knurl may be present. This design allows a machinery device to grip the closure e.g. while the closure is rotated onto the neck finish during application. To prevent that liquid is accumulated on the top deck, the top deck may further comprise a drainage. The drainage may be designed as a slit and/or an interruption in the rim and/or a passage through the rim.

In order to prevent the closure in the open position to be applied further, at least one stopping means may be present on the outer skirt. The stopping means may be designed in form of a circumferential bead arranged in the axial direction away from the top deck and behind the (first circumnavigation) of the lock bead. The stopping means interacts with the thread of the neck finish and block a further application of the closure on the neck finish in the axial direction.

The invention further relates to a liquid container with a neck finish comprising at least one second locking tooth to engage behind the at least one first locking tooth of the closure, as described above. Furthermore, the invention relates to a system of a liquid container with a neck finish and a thereto interconnected closure as described above.

It is to be understood that both the foregoing general description and the following detailed description present embodiments, and are intended to provide an overview or framework for understanding the nature and character of the disclosure. The accompanying drawings are included to provide a further understanding, and are incorporated into and constitute a part of this specification. The drawings illustrate various embodiments, and together with the description serve to explain the principles and operation of the concepts disclosed.

BRIEF DESCRIPTION OF THE DRAWINGS

The herein described invention will be more fully understood from the detailed description given herein below and the accompanying drawings which should not be considered limiting to the invention described in the appended claims. The drawings are showing:

DESCRIPTION OF THE EMBODIMENTS

Reference will now be made in detail to certain embodiments, examples of which are illustrated in the accompanying drawings, in which some, but not all features are shown. Indeed, embodiments disclosed herein may be embodied in many different forms and should not be construed as limited to the embodiments set forth herein; rather, these embodiments are provided so that this disclosure will satisfy applicable legal requirements. Whenever possible, like reference numbers will be used to refer to like components or parts.

Figure 1:
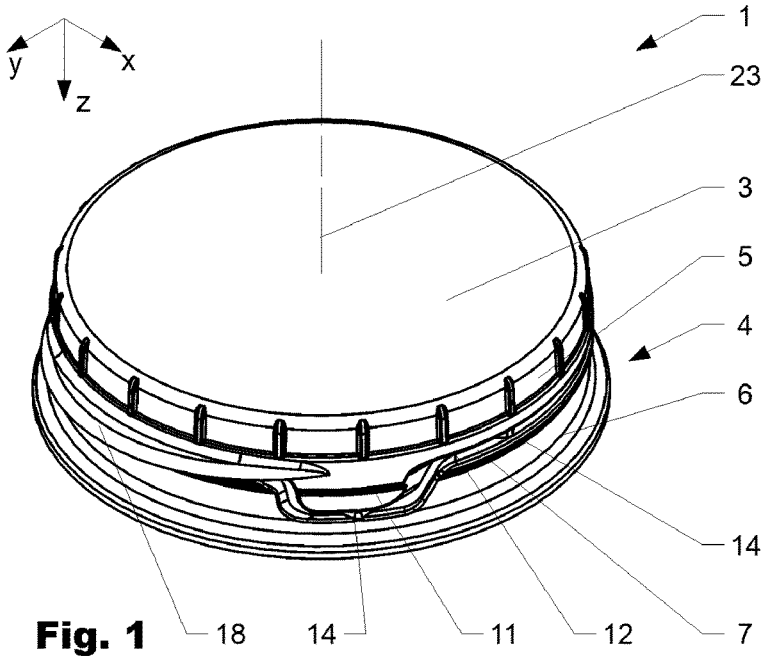
FIG. 1 A first variation of the closure according to the invention in a perspective view.
Figure 2:
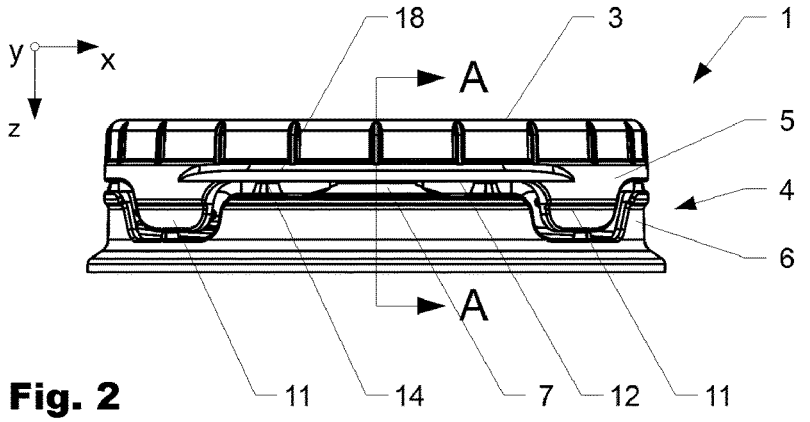
FIG. 2 The closure according to FIG. 1 in a front view.
Figure 3:
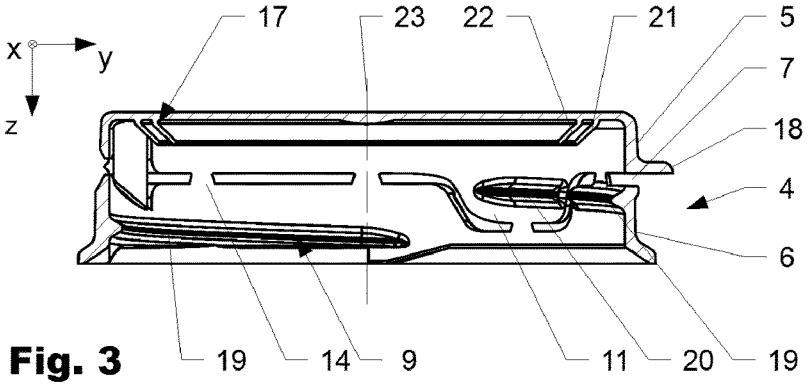
FIG. 3 The closure according to FIG. 2 in a sectionized view A-A.

FIG. 1 to FIG. 5 show a first variation of the closure 1 according to the invention. FIG. 1 and FIG. 2 illustrate the closure 1 in a perspective and a front view. FIG. 3 shows the closure 1 in a sectionized view A-A according to FIG. 2.

The closure 1 according to the first variation of the invention comprises a top deck 3 and an outer skirt 4 extending from the top deck 3 in an axial direction z away from the top deck 3. The outer skirt 4 comprises a top section 5 arranged adjacent to the top deck 2 and a bottom section 6 separated from the top section 5 by a gap 7. The top section 5 and the bottom section 6 are interconnected to each other by a hinge 8. The outer skirt 4 comprises a locking bead 9 extending along an inner surface 10 of the outer skirt 4 and protruding inwardly towards a center axis 23 of the closure. In the shown variation the locking bead 9 is a thread extending along the inner surface 10 of the outer skirt 4 in an inclined manner. Alternatively, the locking bead may however also be a snapped on a corresponding bead arranged on the neck finish of the container by forming an undercut in the axial direction. In FIG. 3, the inner surface 10 of the outer skirt 4 can be observed. The locking bead 9, respectively the thread, continues across the gap 7, with the thread being divided by the gap 7 in at least one first segment 19 arranged on the bottom section 6 of the outer skirt 4 and at least one second segment 20, arranged on the top section 5 of the outer skirt 4. Before initial opening of the closure 1, the bottom section 6 and the top section 5 are interconnected by at least one fragile bridge 14.

The top section 5 comprises at least one fastening flap 11 extending from a lower end 12 of the top section 5 in the axial direction z inside a recess 13 in the bottom section 6. In FIG. 3 is further shown, that the locking bead 9, respectively the thread, continues across the gap 7 into the fastening flap 11. In the shown variation the thread ends on the fastening flap 11, however it is understood that the thread 9 may also continue along the outer skirt 4 crossing the gap 7 at least on a second location back to the bottom section 6.

FIG. 3 further shows sealing means 17 arranged on the top deck 3 of the closure 1 comprising a deformable primary and secondary sealing lip 21,22. The primary and secondary sealing lip 21,22 are arranged on an inner surface of the top deck 3 and extend in a circumferential manner along the top deck 3. The sealing lips 21,22 are arranged with respect to its cross-section in an inclined manner facing radially inwards towards the center axis 23 and away from the outer skirt 4. The secondary sealing lip 22 is arranged coaxially to the primary sealing lip 21 on the inner surface of the top deck 3. If the closure 1 is applied for the first time on a neck finish 2 of the liquid container, the primary and the secondary sealing lip 21,22 are deformed. The secondary sealing lip 22 is configured to support the deformed primary sealing lip 21 with respect to the neck finish 2 in the applied position of the closure 1.

Figure 4:
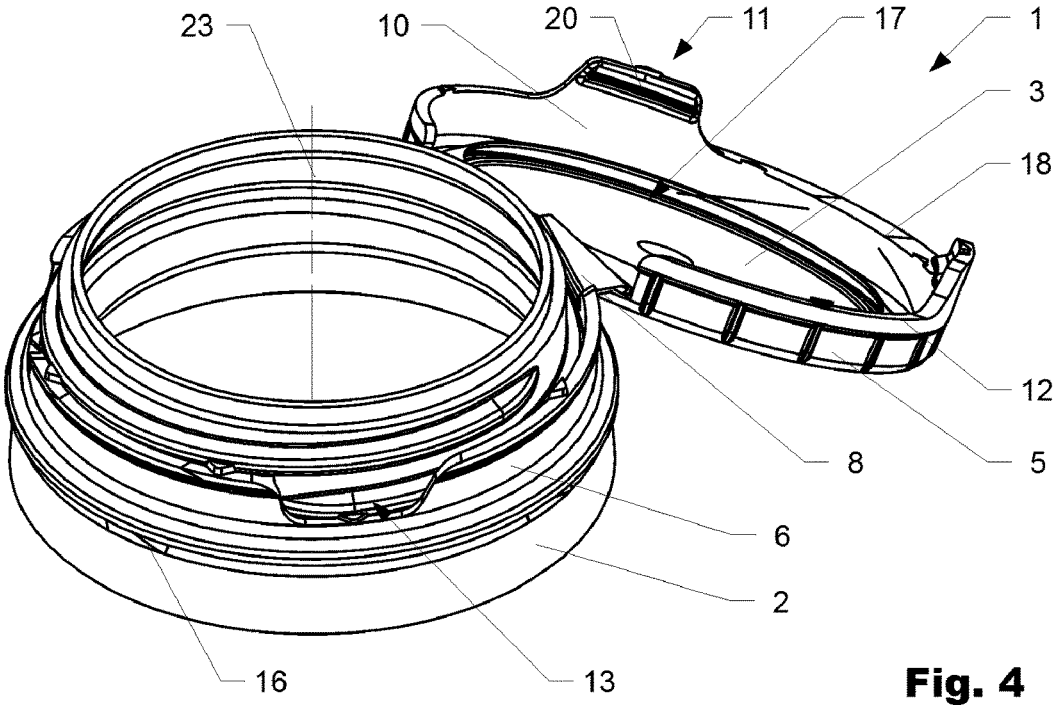
FIG. 4 The closure according to FIG. 1 in an open and applied position.

FIG. 4 illustrates the closure 1 applied on the neck finish 2 (applied position) in an open position. Here the recess 13 in the bottom section 6 of the outer skirt 4 can be seen. Furthermore, the fastening flaps 11 extending from the lower end 12 of the bottom section 6 in the axial direction z can be seen. The arrangement of the locking bead 9 on the top section 5 on the fastening flap 11 is advantageous, since the fastening flap 11 is deformable in the radial outwards direction. Hence an opening and reclosing of the closure is facilitated. As can be seen clearly in FIG. 4, the closure 1 comprises in total two fastening flaps 11. The fastening flaps 11 are arranged on both sides next to a brim 18. The brim 18 extends in the radial direction away from the lower end 12 of the top section 5 and facilitates the opening of the closure 1, respectively the folding back of the top section 6 of the closure 1 around the hinge 8. The brim 18 is arranged opposite of the hinge 8 in the circumferential direction.

Figure 5:
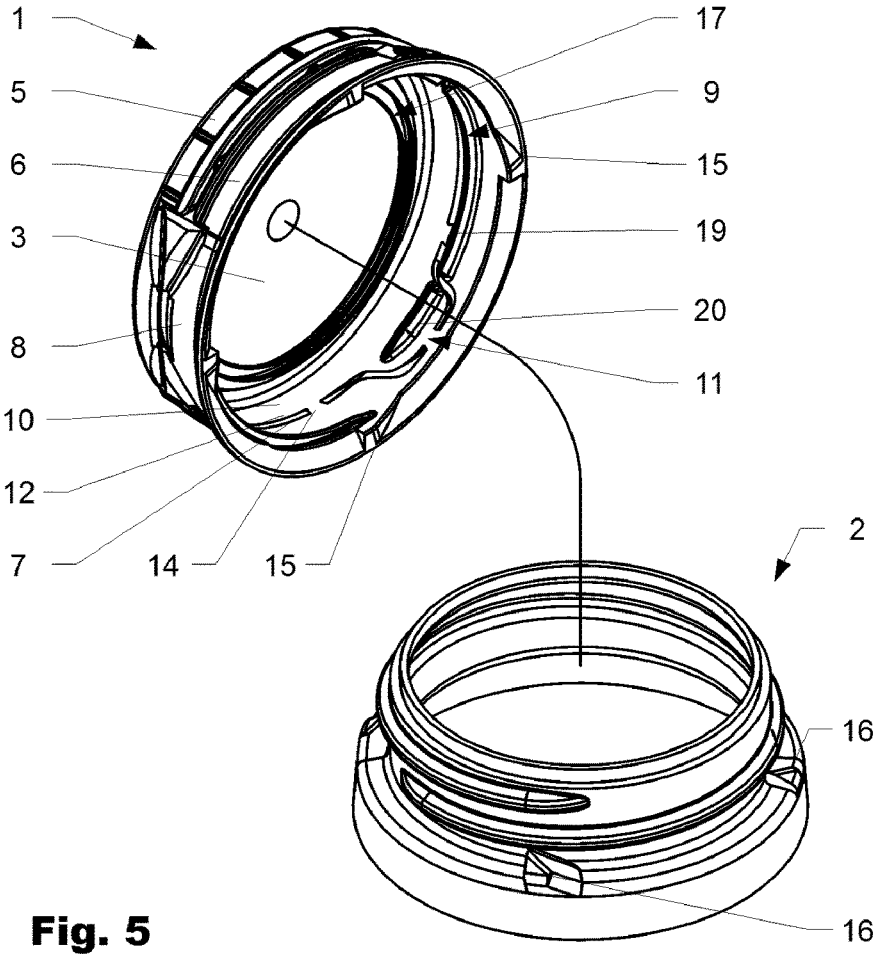
FIG. 5 The closure according to FIG. 1 before the application on a neck finish.

FIG. 5 illustrates the closure 1 according to the first variation of the invention before the first application on the neck finish 2. It can be seen, that the closure 1 comprises at least one first locking tooth 15 arranged on the inner surface 10 of the bottom section 6 of the outer skirt 4. In the shown case four first locking teeth 15 are orientated around the circumference of the closure. Corresponding second locking teeth 16 are arranged on the neck finish of the liquid container. On one hand, the (first and second) locking teeth 15, 16 prevent the closure to be removed from the neck finish 2 once attached. On the other hand, the (first and second) locking teeth 15, 16 position the closure in a predefined manner on the neck finish in the circumferential direction. In the shown variation, the (first and second) locking teeth 15, 16 each comprise a locking shoulder which forms in the applied position of the closure 1 on the neck finish 2 an undercut in the circumferential direction such that a detachment of the closure 1 from the container is prevented.

Figure 6:
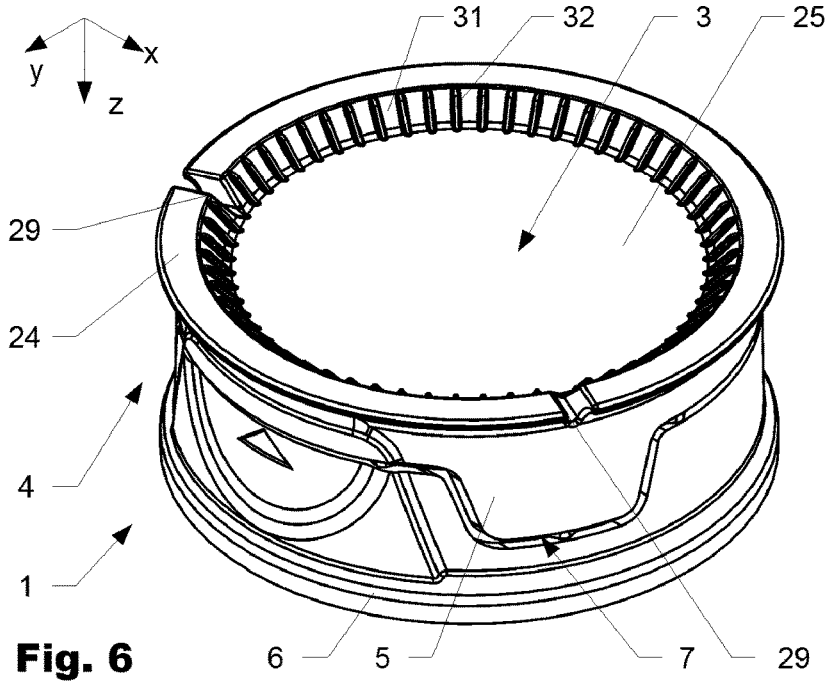
FIG. 6 A second variation of a closure according to the invention in a perspective view.
Figure 7:
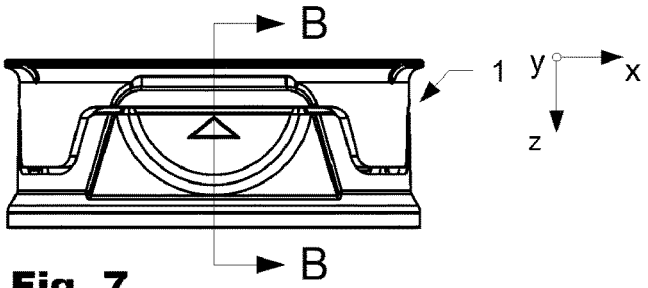
FIG. 7 The second variation of the closure according to FIG. 8 in a front view.
Figure 8:
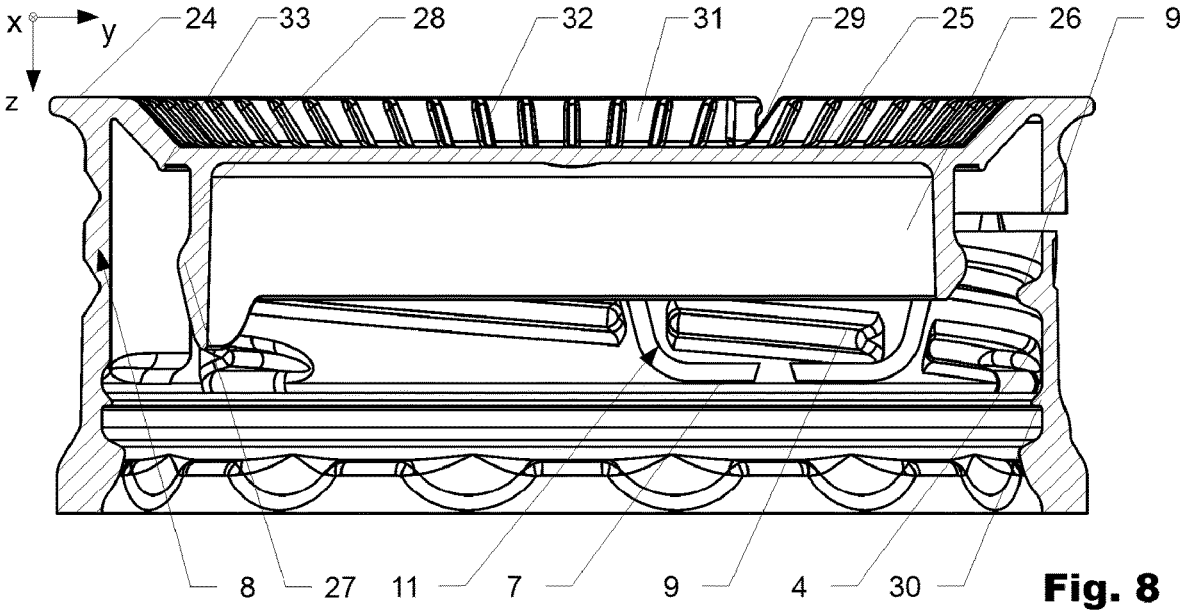
FIG. 8 The second variation of the closure in a sectionized view according to FIG. 7.

FIG. 6 to FIG. 8 show a second variation of the closure 1 according to the invention. FIG. 6 illustrates the closure 1 in a perspective view. FIG. 8 shows the closure 1 in a sectionized view B-B according to FIG. 7.

The second variation of the closure 1 for sealing of a neck finish of a liquid container comprises a top deck 3 and an outer skirt 4 extending from the top deck 3 in the axial direction (z) away from the top deck 3. The outer skirt 4 comprises a top section 5 arranged adjacent to the top deck 3 and a bottom section 6 separated from the top section 5 by a gap 7, as explained above. The top section 5 and the bottom section 6 are interconnected to each other by a hinge 8. The outer skirt 4 comprises an inwardly protruding locking bead 9 extending along an inner surface 10 of the outer skirt 4, wherein the locking bead 9 at at least one location continues across the gap 7, as can be seen in FIG. 8. The overall mechanism for locking the top section 5 on the liquid container is essentially the same as for the first variation of the closure 1 or may be applied accordingly.

However, the second variation of the closure 1 differs from the first variation of the closure in that the top deck 3 has a different structure. The top deck 3 comprises a rim 24 surrounding a top dish 25. The top dish 25 is preferably circular and set back (towards the outer skirt) in the axial direction with respect to the rim 24. This design allows for the hinge to be placed in the axial direction closer to the top deck and thus results in less collision risk during opening and closing. An inner skirt 26 extents from the inner surface of the top dish 25. The inner skirt 26 is circumvented by the outer skirt 4. The inner skirt 26 is arranged coaxially with respect to the outer skirt 4 and with respect to the center axis 23 of the closure 1. The inner skirt 26 varies in length in the axial direction over its circumference. Preferably, the inner skirt 26 comprises on a first surface 28, which is facing towards the outer skirt 4, a circumferential sealing bead 27. An additional top seal 33 may be present on the inner surface of the top deck 3 between the inner skirt 26 and the outer skirt 4 for contacting and sealing the top end of the neck finish from the axial direction.

The rim 24 may comprise at least one drainage 29. The drainage 29 may be designed as a slit and/or an interruption and/or a passage in the rim for liquid accumulated on the top deck 3. Between the rim 24 and the top dish 25 a transition area 31 is present. The transition area 31 may be e.g. a bevelled surface angled towards the center axis 23. On the transition area 31, respectively on the bevelled surface, additional rips may be present. In the shown variation, a knurl 32 extends on the bevelled surface allowing a machinery device to grip the closure e.g. while the closure 1 is rotated onto the neck finish during application.

In order to prevent the closure 1 in the open position to be applied further, at least one stopping means 30 may be present on the outer skirt 4. The stopping means 30 may be designed in form of a circumferential bead arranged in the axial direction away from the top deck and behind the (first circumnavigation) of the lock bead. The stopping means 31 interacts with the thread of the neck finish and block a further application of the closure 1 on the neck finish in the axial direction.

The words used in the specification are words of description rather than limitation, and it is understood that various changes may be made without departing from the spirit and scope of the invention.

LIST OF DESIGNATIONS

| | | | |
|---|---|---|---|
| 1 | Closure | 18 | Brim |
| 2 | Neck finish | 19 | First thread segment |
| 3 | Top deck | 20 | Second thread segment |
| 4 | Outer skirt | 21 | Primary sealing lip |
| 5 | Top section | 22 | Secondary sealing lip |
| 6 | Bottom section | 23 | Center axis |
| 7 | Gap | 24 | Rim |
| 8 | Hinge | 25 | Top dish |
| 9 | Locking bead/thread | 26 | Inner skirt |
| 10 | Inner surface | 27 | Sealing bead |
| 11 | Fastening flap | 28 | First surface |
| 12 | Lower end | 29 | Drainage |
| 13 | Recess | 30 | Stopping means |
| 14 | Fragile bridge | 31 | Transition area |
| 15 | First locking tooth | 32 | Knurl |
| 16 | Second locking tooth | 33 | Top seal |
| 17 | Sealing means | | |

The invention claimed is:

1. A closure, for sealing of a neck finish of a liquid container, comprising:

a top deck and an outer skirt extending from the top deck in an axial direction (z) away from the top deck;

the outer skirt comprising a top section arranged adjacent to the top deck and a bottom section separated from the top section by a gap; and the top section and the bottom section are interconnected to each other by a hinge;

wherein:

the outer skirt comprises an inwardly protruding locking bead extending along an inner surface of the outer skirt;

the locking bead at at least one location continues across the gap; and the locking bead is a thread for interconnecting the closure to the neck finish;

the thread includes a first segment that protrudes inwardly along an inner surface of the bottom section of the outer skirt;

the thread includes a second segment that protrudes inwardly along an inner surface of the top section of the outer skirt, the second segment nearer to the top deck than the first segment.

2. The closure according to claim 1, wherein the top section comprises at least one fastening flap extending from a lower end of the top section in the axial direction (z) inside a recess of the bottom section, wherein the locking bead continues across the gap into the fastening flap.

3. The closure according to claim 2, wherein the fastening flap is arranged within a contour of the top deck in the axial direction (z).

4. The closure according to claim 2, wherein the fastening flap is deformable in a radial direction.

5. The closure according to claim 1, wherein in an initial position, before initial opening of the closure, the top section and the bottom section are interconnected by at least one fragile bridge.

6. The closure according to claim 1, wherein the top section comprises a brim arranged in a circumferential direction opposite of the hinge, extending in a radial direction away from the top section to facilitate opening of the closure.

7. The closure according to claim 6, wherein the closure comprises two fasting flaps and respective recesses arranged in a circumferential direction adjacent to the brim.

8. The closure according to claim 1, wherein the closure comprises at least one first locking tooth arranged on the inner surface on the bottom section for locking the closure with respect to the circumferential direction on the neck finish of the liquid container.

9. The closure according to claim 8, wherein the at least one first locking tooth is arranged at a lower end of the bottom section.

10. The closure according to claim 8, wherein the at least one first locking tooth is arranged adjacent to the recess in the bottom section.

11. The closure according to claim 1, wherein the top deck comprises a top dish circumvented by a rim, wherein the top dish has an offset in the axial direction with respect to said rim.

12. The closure according to claim 11, wherein an inner skirt extends from the inner surface of the top dish.

13. A liquid container with a neck finish comprising at least one second locking tooth foreseen to engage behind the at least one first locking tooth of the closure according to claim 8.

14. A system of a liquid container having a neck finish and a thereto interconnected closure according to claim 1.

* * * * *